US005690166A

United States Patent [19]

Yamaguchi

[11] Patent Number: 5,690,166

[45] Date of Patent: Nov. 25, 1997

[54] HEAT EXCHANGER WITH DIVIDED HEADER TANK

[75] Inventor: Tomohiro Yamaguchi, Isesaki, Japan

[73] Assignee: Sanden Corporation, Gunma, Japan

[21] Appl. No.: 654,293

[22] Filed: May 28, 1996

[30] Foreign Application Priority Data

May 30, 1995 [JP] Japan ..... 7-154038

[51] Int. Cl.[6] ..... F28F 27/00

[52] U.S. Cl. ..... 165/96; 165/174; 165/176

[58] Field of Search ..... 165/151, 153, 165/173–176, 96

[56] References Cited

U.S. PATENT DOCUMENTS 4,559,994 12/1985 Waldmann et al. ..... 165/176 X

FOREIGN PATENT DOCUMENTS 0640804 3/1995 European Pat. Off. .
1234123 9/1989 Japan .
124501 4/1992 Japan .

*Primary Examiner*—Leonard R. Leo
*Attorney, Agent, or Firm*—Baker & Botts, L.L.P.

[57] ABSTRACT

The present invention is directed to a heat exchanger having a divided header tank. The heat exchanger has a pair of header tanks and a plurality of pipe members, by which the header tanks are placed in fluid communication. A partitioning plate is fixedly disposed within a hollow space of one of the header tanks, so that the hollow space is divided into two chamber sections. A gap is defined between the pair of header tanks corresponding to the partitioning plate. A blocking element is disposed within the gap, so that air which otherwise would pass through the gap is blocked, and the overall heat exchange operation of the heat exchanger is improved.

12 Claims, 8 Drawing Sheets

HEAT EXCHANGER WITH DIVIDED HEADER TANK

BACKGROUND OF THE INVENTION

1. Field of the Invention

The present invention relates generally to a heat exchanger, and more particularly, to a heat exchanger having a divided header tank.

2. Description of the Related Art

Heat exchangers having a divided header tank are known in the art. For example, Japanese Patent Application Publication No. 7-55384 describes such a heat exchanger, substantially as depicted in FIGS. 1–4.

With reference to FIGS. 1–4, a heat exchanger 10' functions as an evaporator for an automotive air conditioning system and includes upper and lower header tanks 11 and 12, which are vertically spaced from each other, and a plurality of pipe members 13, which place the pair of header tanks 11 and 12 in fluid communication. Further, for purposes of explanation only, in FIG. 2, the lower portion of the figure is referred to as the front or forward side, and the upper portion of the figure is referred to as the rear or rearward side.

As depicted in FIG. 2, pipe members 13 are arranged to form a plurality of rows 131 which are parallel to both a pair of second side regions **113*b* of a sidewall portion 113 of upper header tank 11 and a pair of second side regions 123*b* of a sidewall portion 123 of lower header tank 12. Adjacent rows 131 are offset from each other by one half of the interval between pipe members 13**.

More specifically, as depicted in FIG. 5, adjacent rows 131 of pipe members 13 are arranged, such that a plane surface $S_1$ and a plane surface $S_2$ overlap each other, but do not extend beyond plane surfaces $S_{22}$ and $S_{11}$, respectively. In this relationship, plane surface $S_1$ includes longitudinal straight lines $L_1$. Each line $L_1$ contains each of the innermost points of one of pipe members 13 in a first adjacent row 131. Plane surface $S_2$ includes longitudinal straight lines $L_2$. Each line $L_2$ contains each of the innermost points of one of pipe members 13 of a second adjacent row 131. Plane surface $S_{11}$ includes a longitudinal-central axis $L_{11}$ of each of pipe members 13 for first adjacent row 131. Plane surface $S_{22}$ includes a longitudinal central axis $L_{22}$ of each of pipe members 13 of second adjacent row 131.

Moreover, although only four pipe members 13 are illustrated in FIG. 1, plurality of pipe members 13 are disposed between upper and lower header tanks 11 and 12 in an arrangement, such as that depicted in FIG. 2.

With reference to FIG. 4, upper header tank 11 has a rectangular parallelpiped shape and includes a top portion 111, a bottom portion 112, and a circumferential sidewall portion 113 which connects top and bottom portions 111 and 112. Sidewall portion 113 includes a pair of first side regions **113*a*, each having a first longitudinal length, and a pair of second side regions 113*b*, each having a second longitudinal length which is shorter than the first longitudinal length. The pair of first side regions 113*a* are parallel to each other, and the pair of second side regions 113*b*** are similarly parallel to each other.

Upper header tank 11 further includes first and second rectangular partitioning plate members 15 and 16 which are fixedly disposed within upper header tank 11 in an upright orientation. A longitudinal length of first plate member 15 is greater than that of second plate member 16. First and second plate members 15 and 16 are positioned to be parallel to the pair of first side regions **113*a* and the pair of second side regions 113*b*, respectively. First and second plate members 15 and 16 intersect each other at right angles at their longitudinal centers. Accordingly, an inner hollow space 110 of upper header tank 11 is divided into identical first through fourth chamber sections 110*a*, 110*b*, 110*c*, and 110*d*, by first and second plate members 15 and 16**.

Similarly, lower header tank 12 has a rectangular parallelpiped shape and includes a top portion 121, a bottom portion 122, and a circumferential sidewall portion 123 which connects top and bottom portions 121 and 122. The size of top and bottom portions 121 and 122 of lower header tank 12 and that of top and bottom portions 111 and 112 of upper header tank 12 are identical. Sidewall portion 123 includes a pair of first side regions **123*a*, each having a first longitudinal length, and a pair of second side regions 123*b*, each having a second longitudinal length. The pair of first side regions 123*a* are parallel to each other, and the pair of second side regions 123*b*** are similarly parallel to each other.

Lower header tank 12 further includes third and fourth rectangular partitioning plate members 17 and 18 which are fixedly disposed within lower header tank 12 in an upright orientation. A longitudinal length of third plate member 17 is greater than that of fourth plate member 18. Third and fourth plate members 17 and 18 are parallel to the pair of first side regions **123*a* and the pair of second side regions 123*b*, respectively. Third and fourth plate members 17 and 18 intersect each other at right angles at their longitudinal centers. Accordingly, an inner hollow space 120 of lower header tank 12 is divided into identical first through fourth chamber sections 120*a*, 120*b*, 120*c*, and 120*d*, by third and fourth plate members 17 and 18**.

A plurality of, for example, three, first circular holes **16*a* are formed in one half portion of the second plate member 16 (to the left in FIG. 4), so that second and third chamber sections 110*b* and 110*c* of inner hollow space 100 of upper header tank 11 are in fluid communication with each other. A plurality of, for example, three, second circular holes 17*a* are formed in a first half portion of third plate member 17 (to the right in FIG. 4), so that first and second chamber sections 120*a* and 120*b* of inner hollow space 120 of lower header tank 12 are in fluid communication with each other. A plurality of, for example, three, third circular holes 17*b* are formed in a second half portion of third plate member 17 (to the left in FIG. 4), so that third and fourth chamber sections 120*c* and 120*d* of inner hollow space 120 of the lower header tank 12** are in fluid communication with each other.

First and second circular openings 21 and 22 are formed in one of the pair of first side regions **113*a* of sidewall portion 113 of upper header tank 11 at locations corresponding to first and fourth chamber sections 110*a* and 110*d*, respectively. One end of an inlet pipe 31 is fixedly received within first circular hole 21, so that first chamber section 110*a* of inner hollow space 110 of upper header tank 11 is in fluid communication with an external element of a refrigerant circuit of the automotive air conditioning system, for example, a condenser (not shown). Similarly, one end of an outlet pipe 32 is fixedly received within second circular hole 22, so that fourth chamber section 110*d* of inner hollow space 110 of upper header tank 11** is in fluid communication with another external element of the refrigerant circuit, for example, a refrigerant compressor (not shown).

Upper and lower tanks 11 and 12, pipe members 13, first through fourth rectangular plate members 15–18, and inlet and outlet pipes 31 and 32 may be made of aluminum, e.g., an aluminum alloy, and they may be connected to one another to form a secure and liquid-tight seal at their mating surfaces, for example, by brazing. This connecting process may be performed after a process of temporarily assembling the heat exchanger is completed.

With reference to FIGS. 1 and 2, a pair of rectangular side plates 30 are disposed adjacent to the opposite outermost rows 131 of pipe members 13, respectively. Side plates 30 positioned parallel to rows 131 of pipe members 13. Upper end portion of the pair of side plates 30 are fixedly connected to a lower end section of the pair of second side regions 113*b* of sidewall portion 113 of upper header tank 11, respectively, for example, by brazing. Lower end portions of the pair of side plates 30 are fixedly connected to upper end sections of the pair of second side regions 123*b* of sidewall portion 123 of lower header tank 12, respectively, for example, by brazing.

In general, heat exchanger 10' is installed, such that the pair of second side region 113*b* of sidewall portion 113 of upper header tank 11 and the pair of second side region 123*b* of sidewall portion 123 of lower header tank 12 are oriented parallel to the flow direction of air, which passes across heat exchanger 10' as indicated by the large arrows "A" in FIGS. 2 and 4. Thus, heat exchanger 10' is generally installed, such that second and fourth plate members 16 and 18 are oriented parallel to the air flow direction indicated by the large arrows "A" in FIGS. 2 and 4.

Operation of heat exchanger 10' is described in detail below with reference to FIG. 4. As indicated by solid line arrows "D," the refrigerant flowing from one external element of the refrigerant circuit, for example, the condenser (not shown), is conducted into first chamber section 110*a* of inner hollow space 110 of upper header tank 11 through inlet pipe 31. The refrigerant flowing into first chamber section 110*a* of inner hollow space 110 of upper header tank 11, then is dispersed between and flows downwardly through a first group of pipe members 13, which places first clamber section 110*a* of inner hollow space 110 of upper header tank 11 in fluid communication with first chamber section 120*a* of inner hollow space 120 of lower header tank 12. The refrigerant flowing through the first group of pipe members 13 flows into first chamber section 120*a* of inner hollow space 120 of lower header tank 12.

The refrigerant flowing into first chamber section 120*a* of inner hollow space 120 of lower header tank 12 then flows into second chamber section 120*b* of inner hollow space 120 of lower header tank 12 through second circular holes 17*a* formed in the first half portion of third plate member 17 (to the right in FIG. 4).

The refrigerant flowing into second chamber section 120*b* of inner hollow space 120 of lower header tank 12 then is dispersed between and flows upwardly through a second group of pipe members 13, which places second chamber section 110*b* of inner hollow space 110 of upper header tank 11 in fluid communication with second chamber section 120*a* of inner hollow space 120 of lower header tank 12. The refrigerant flowing through the second group of pipe members 13 flows into second chamber section 110*b* of inner hollow space 110 of upper header tank 11.

The refrigerant flowing into second chamber section 110*b* of inner hollow space 110 of upper header tank 11 then flows to third chamber section 110*c* of inner hollow space 110 of upper header tank 11 through first circular holes 16*a* formed in one half portion of second plate member 16 (to the left in FIG. 4).

The refrigerant flowing into third chamber section 110*c* of inner hollow space 110 of upper header tank 11 then is dispersed between and flows downwardly through a third group of pipe members 13, which places third chamber section 110*c* of inner hollow space 110 of upper header tank 11 in fluid communication with third chamber section 120*c* of inner hollow space 120 of lower header tank 12. The refrigerant flowing through the third group of pipe members 13 flows into third chamber section 120*c* of inner hollow space 120 of lower header tank 11.

The refrigerant flowing into third chamber section 120*c* of inner hollow space 120 of lower header tank 12 flows into fourth chamber 120*d* of inner hollow space 120 of lower header tank 12 through third circular holes 17*b* formed in the second half portion of third plate member 17 (to the left in FIG. 4).

The refrigerant flowing into fourth chamber section 120*d* of inner hollow space 120 of lower header tank 12 then is dispersed between and flows upwardly through a fourth group of pipe members 13, which places fourth chamber section 110*d* of inner hollow space 110 of upper header tank 11 in fluid communication with fourth chamber section 120*d* of inner hollow space 120 of lower header tank 12. The refrigerant flowing through the fourth group of pipe members 13 flows into the fourth section 110*d* of the inner hollow space 110 of the upper header tank 11 and then is conducted into another external element of the refrigerant circuit, for example, the refrigerant compressor (not shown), through outlet pipe 32.

When the refrigerant shuttles between upper and lower header tanks 11 and 12 through the first through fourth groups of pipe members 13, respectively, the refrigerant in pipe members 13 exchanges heat with the air, which passes across heat exchanger 10' as indicated by the large arrows "A" in FIGS. 2 and 4. In this heat exchanging operation, the heat of the air is absorbed by the refrigerant, so that the refrigerant is vaporized, and the air is cooled.

Due to the construction of heat exchanger 10', no pipe member 13 is disposed within a space 200, which is defined between upper and lower header tanks 11 and 12 at about the location corresponding to second and fourth plate members 16 and 18. Similarly, no pipe member 13 is disposed within a space 300, which is defined between upper and lower header tanks 11 and 12 at about the location corresponding to the first and third plate members 15 and 17.

Accordingly, as depicted in FIG. 2, the air passes through heat exchanger 10' in two flow paths during operation of heat exchanger 10'. In the first path, the air flows straight through space 200 as indicated by arrow "C." In the second path, the air flows through the other space 400, in which pipe members 13 are disposed, in a meandering course along the curved exterior surfaces of pipe members 13 as indicated by arrow "B." As a result, when considering the efficiency of heat exchange between the air with the refrigerant, space 200 is smaller than space 400. However, despite this comparison of the ratios of the front leading surface area between space 200 and space 400, the mount of air flowing through space 200 becomes greater than the amount of air flowing through space 400. Therefore, the overall heat exchange operation of heat exchanger 10' is inefficient.

SUMMARY OF THE INVENTION

Accordingly, an object of the present invention is to improve the efficiency of the overall heat exchange operation of a heat exchanger which includes a divided header tank.

In order to achieve this object, a heat exchanger according to the present invention includes a pair of header tanks spaced from each other. Each of the pair of header tanks comprises a top end portion, a bottom end portion spaced from the top end portion, and a sidewall portion connecting the top and bottom end portions, so that a hollow space is defined within each header tanks. The sidewall portion of each of the pair of header tanks includes a first side and a second side which is spaced from and parallel to the first side.

A plurality of pipe members are disposed between the pair of header tanks and place the pair of header tanks in fluid communication. At least one partitioning member is fixedly disposed within the hollow space of at least one header tank parallel to the first and second sides of the sidewall portion of each of the pair of header tanks, so that the inner hollow space of the at least one header tank is divided into at least two chamber sections. At least one gap or space is formed between the pair of header tanks corresponding to the at least one partitioning member. At least one blocking element is fixedly disposed within the at least one gap or space.

DETAILED DESCRIPTION OF THE PREFERRED EMBODIMENT

Figure 1:
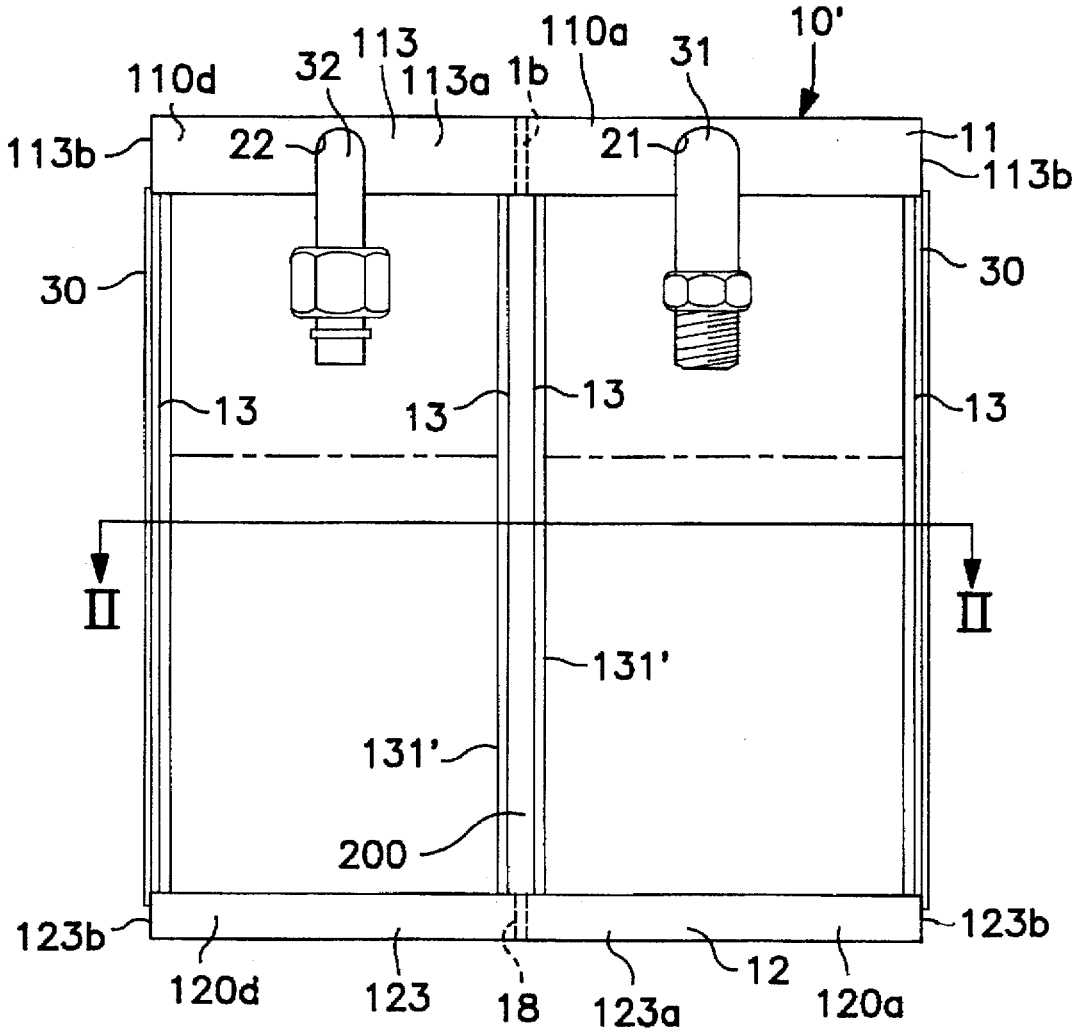
FIG. 1 (PRIOR ART)
FIG. 1 is a front view of a heat exchanger in accordance with a prior art embodiment.

FIGS. 5–8 depict a heat exchanger in accordance with a first embodiment of the present invention. In FIGS. 5–8, the same numerals and letters are used to denote corresponding elements depicted in FIGS. 1–4, so that further explanation thereof is here omitted. Moreover, for purposes of explanation only, in FIGS. 6 and 7, the lower portion of the figure is referred to as the front or forward side, and the upper portion of the figure is referred to as the rear or rearward side.

With reference to FIGS. 5–8, a blocking element 41 is fitted within the entire space 200. Blocking element 41 may be a U-shaped plate member 410 made of, for example, aluminum, e.g., an aluminum alloy. U-shaped plate member 410 may include a pair of plane portions 411 which are spaced from and parallel to each other and a connecting portion 412 which connects plane portions 411 at their rear ends. A pair of flanges **411*a* may be formed at a front end region of the plane portions 411 opposite to connecting portion 412**, respectively, by means of the outwardly bending thereof at right angles.

In an assembling process of heat exchanger 10, U-shaped plate member 410 may be inserted into space 200 from the forward side while plane portions 411 are in close contact with pipe members 13 of the pair of rows 131' between which space 200 intervenes. Insertion of U-shaped plate member 410 into space 200 is complete when the pair of flanges **411*a* of plate member 410 come in contact with the forward-most pipe member 13 of the pair of rows 131,' respectively. At that moment, connecting portion 412 of plate member 410 extends across space 200 and is generally aligned with a rear-side of the outer peripheral surface of the rear-most pipe member 13 of the pair of rows 131'. When the assembling process of heat exchanger 10 is complete, plate member 410 and pipe members 13 of the pair of rows 131'** are fixedly connected to each other at their contacting surfaces, for example, by brazing.

As described above, because blocking element 41 is fitted within the entire space 200, the flow path of the air, which would otherwise pass through the space 200, is completely blocked during operation of the heat exchanger 10. Accordingly, all of the air passes through space 400, in which pipe members 13 are disposed, and flows in a meandering course along the curved exterior surfaces of pipe members 13, as indicated by arrow "B" in FIG. 6, during operation of heat exchanger 10. Thus, the efficiency of heat exchange operation at space 400 is higher relative to that at space 200. Therefore, the efficiency of the overall heat exchange operation of heat exchanger 10 is improved.

Figure 9:
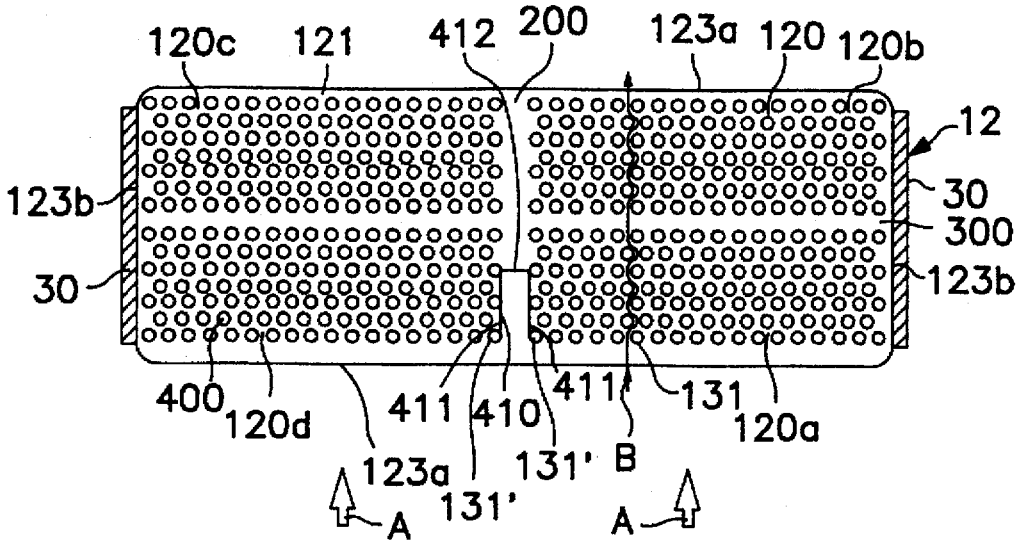
FIG. 9 is a view similar to FIG. 6. A portion of a heat exchanger in accordance with a second embodiment of the present invention is depicted.
Figure 10:
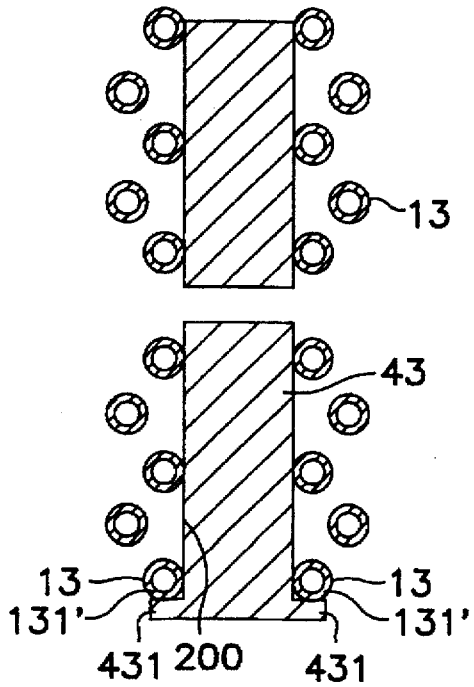
FIG. 10 is a view similar to FIG. 7. A portion of a heat exchanger in accordance with a third embodiment of the present invention is depicted.
Figure 11:
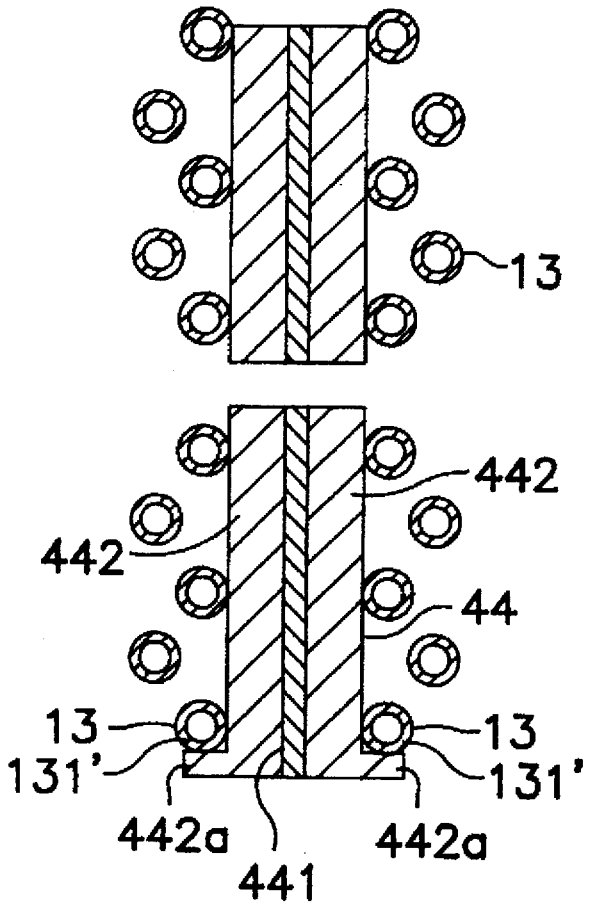
FIG. 11 is a view similar to FIG. 7. A portion of a heat exchanger in accordance with a fourth embodiment of the present invention is depicted.

FIGS. 9, 10, and 11 illustrate a portion of a heat exchanger in accordance with a second, third, and fourth embodiments of the present invention, respectively. In FIGS. 9, 10, and 11, the same numerals and letters are used to denote the corresponding elements depicted in FIGS. 6 and 7, so that further explanation thereof is here omitted. In addition, for purposes of explanation only, in FIGS. 9, 10, and 11, the lower portion of the figures is referred to as the front or forward side, and the upper portion of the figures is referred to as the rear or rearward side.

With reference to FIG. 9, in the second embodiment of the present invention, connecting portion 412 of plate members 410 may extend across space 200 to a depth which is about one-third length of rows 131 of pipe members 13.

With reference to FIG. 10, in the third embodiment of the present invention, a blocking element 43 may be elastically fitted within space 200. Blocking element 43 is made of a material retaining elasticity and having high durability in wet and low temperature environments. Preferably, ethylene-propylene terpolymer (EPDM) is selected as the material of blocking element 43. Blocking element 43 may also include a pair of flanges 431 formed at a front end thereof.

When a brazing process is completed, blocking element 43 may be inserted into space 200 while blocking element 43 is elastically fitted into contact with pipe members 13 of the pair of rows 131' between which space 200 intervenes. Insertion of blocking element 43 into space 200 is completed when the pair of flanges 431 of blocking element 43 come into contact with the forward-most pipe member 13 of the pair of rows 131', respectively.

With reference to FIG. 11, in the fourth embodiment of the present invention, a blocking element 44 may be employed in place of blocking element 43 of the third embodiment. Blocking element 44 may include a rectangular core plate member 441 and a pair of shell members 442 which sandwich core plate member 441. Each of the pair of shell members 442 may include a flange 442*a* which is formed at a front end thereof. Core plate member 441 may be made of aluminum, e.g., an aluminum alloy, and shell members 442 are made of a material retaining elasticity and having high durability in wet and in low temperature. Preferably, ethylene-propylene terpolymer (EPDM) in selected as the material of the shell members 442.

According to the third and fourth embodiments, even though blocking element 43 (44) is inserted into space 200 closely contacting with pipe members 13 of the pair of rows 131', pipe members 13 of the pair of rows 131' are not damaged due to the elasticity of blocking element 43 (44).

The other effects of the second through fourth embodiments of the invention are substantially similar to those of the first embodiment, so that further explanation thereof is here omitted.

Figure 2:
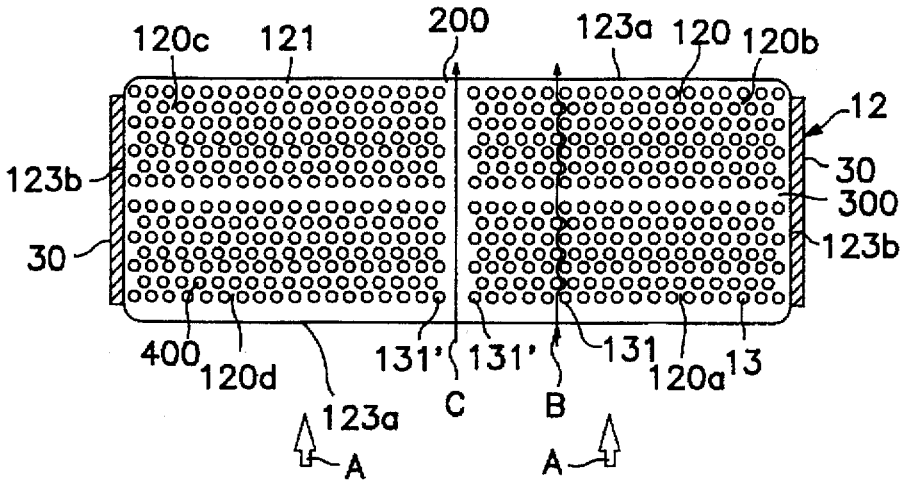
FIG. 2 (PRIOR ART)
FIG. 2 is a cross-sectional view taken along line II—II of FIG. 1.
Figure 3:
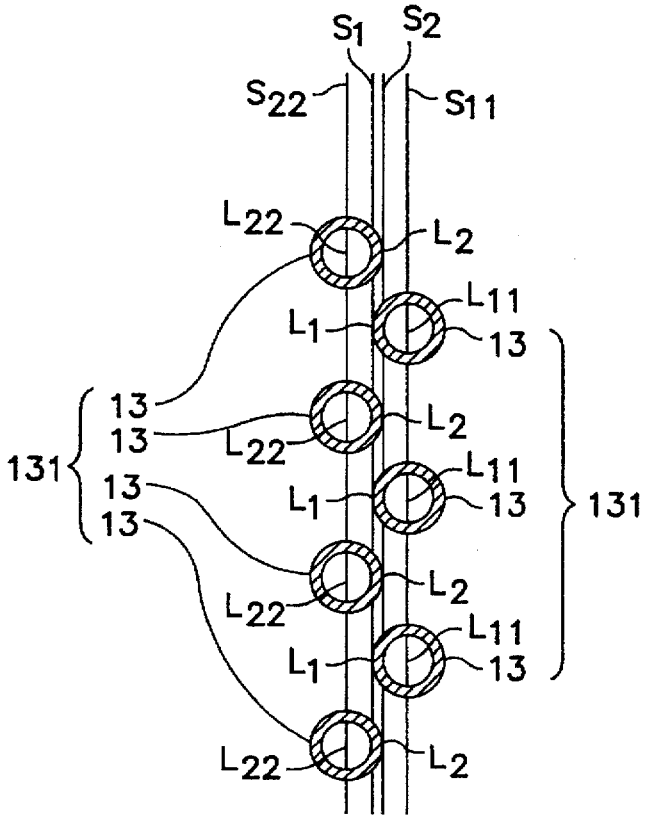
FIG. 3 (PRIOR ART)
FIG. 3 is an enlarged partial view taken from FIG. 2.
Figure 4:
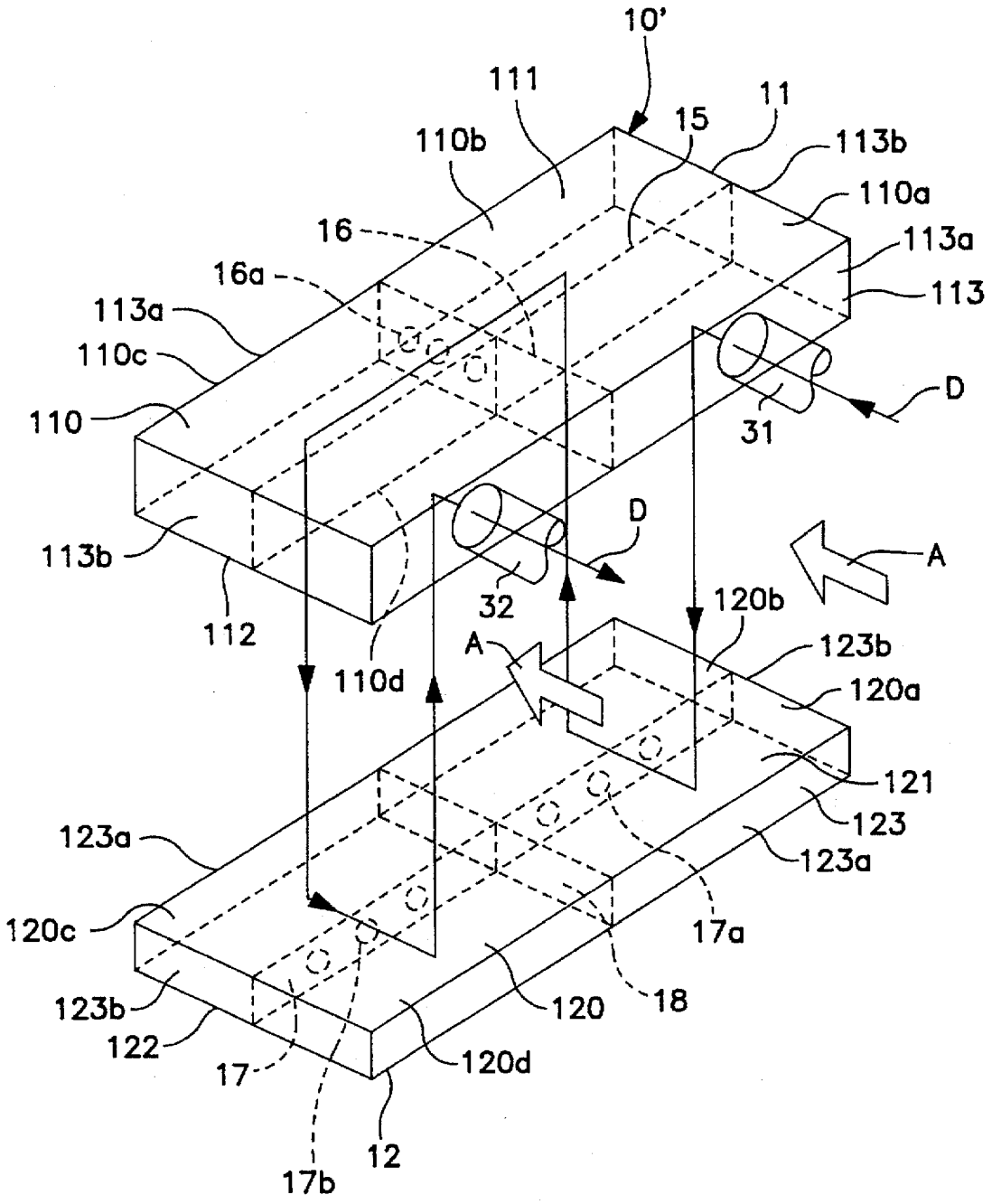
FIG. 4 (PRIOR ART)
FIG. 4 is a schematic perspective view of the heat exchanger shown in FIG. 1. A flow path of the refrigerant through the heat exchanger of FIG. 1 is depicted.
Figure 5:
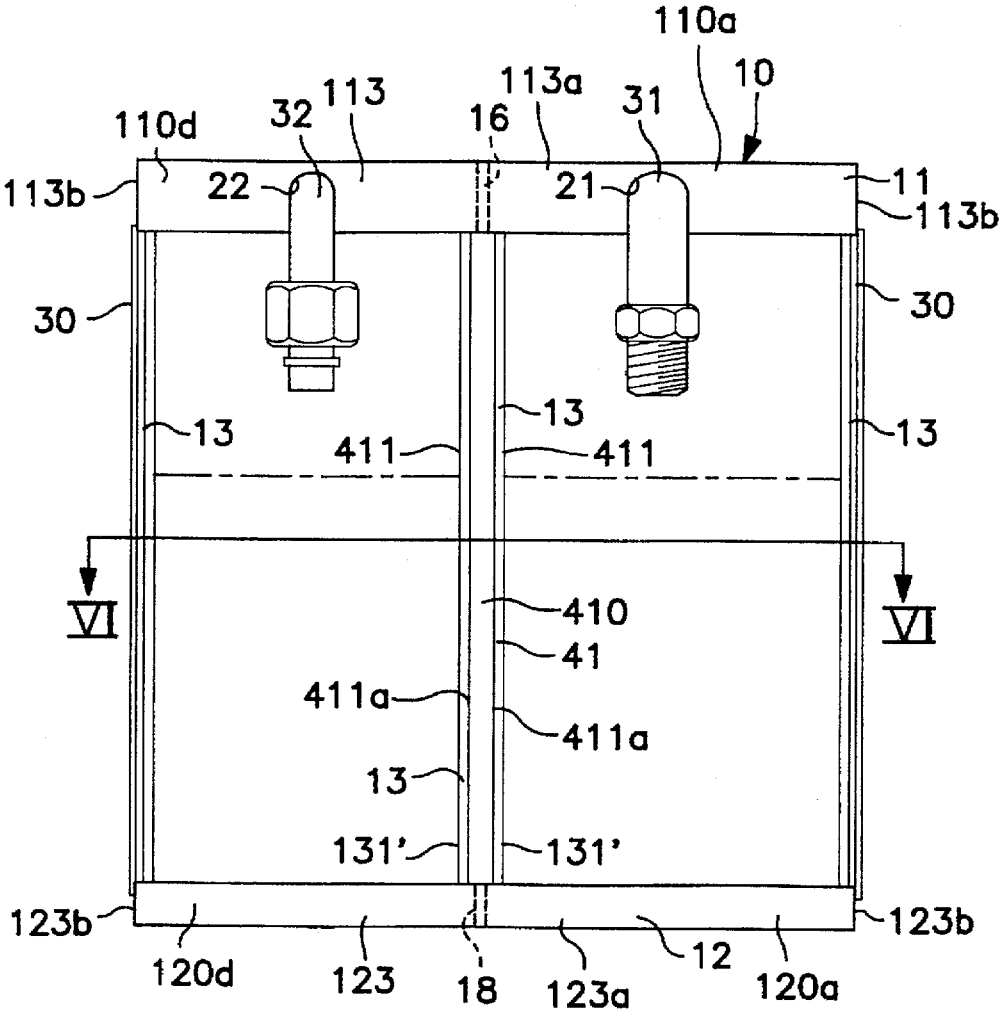
FIG. 5 is a frontal view of a heat exchanger in accordance with a first embodiment of the present invention.
Figure 6:
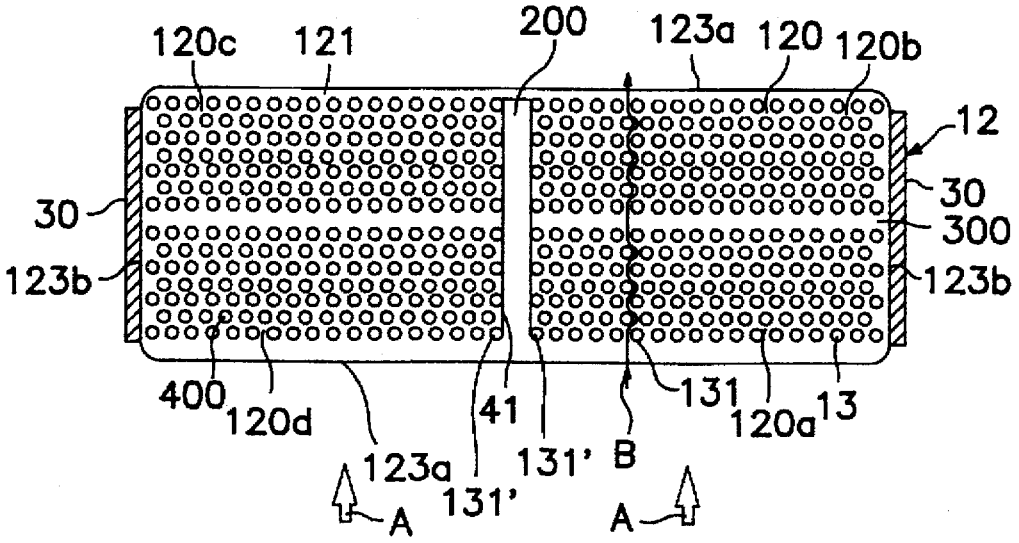
FIG. 6 is a cross-sectional view taken along line VI—VI of FIG. 5.
Figure 7:
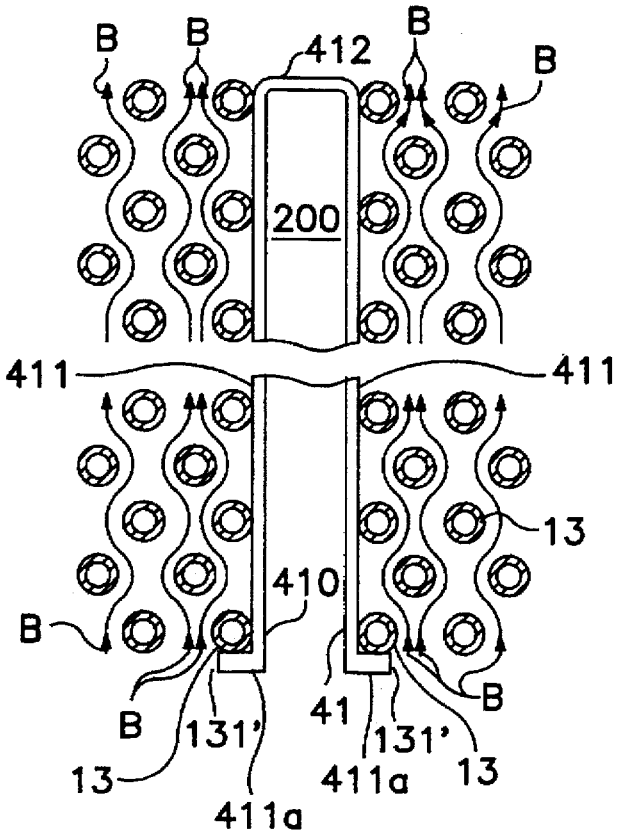
FIG. 7 is an enlarged partial view taken from FIG. 6.
Figure 8:
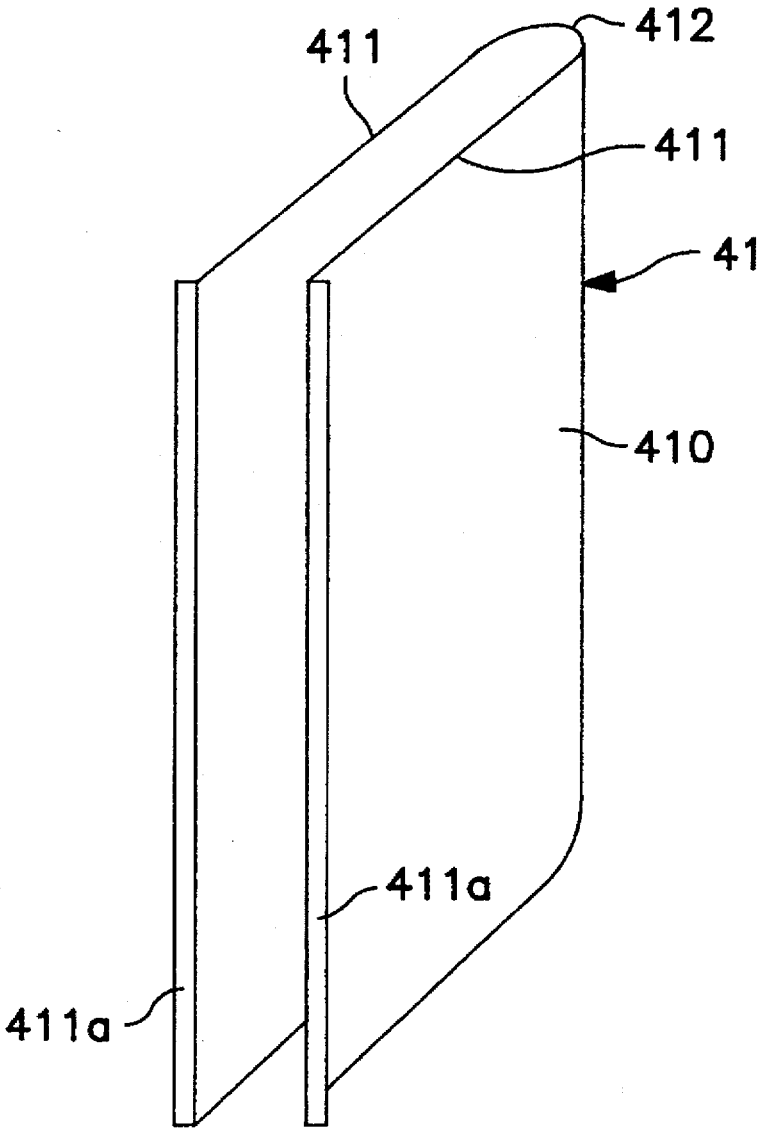
FIG. 8 is a perspective view of a blocking element shown in FIG. 5.

Moreover, pipe members 13 are not limited to the configuration illustrated in FIGS. 2 and 3, such as a lattice.

This invention has been described in detail in connection with the preferred embodiments. These embodiments, however, are merely exemplary, and the invention is not restricted thereto. It will be understood by those skilled in the art that other variations and modifications may be made within the scope of this invention as defined by the appended claims.

What is claimed is:

1. A heat exchanger comprising:

a pair or header tanks spaced from each other, wherein each of the pair of header tanks comprises a top end portion, a bottom end portion spaced from the top end portion, and a sidewall portion connecting the top and bottom end portions, so that a hollow space is defined within each of the pair of header tanks; and wherein the sidewall portion of each of the pair of header tanks includes a first side and a second side which is spaced from and parallel to the first side;

a plurality of pipe members placing the pair of header tanks in fluid communication;

at least one partitioning member fixedly disposed within the hollow space of at least one header tank parallel to the first and second sides of the sidewall portion of each of the pair of header tanks, so that the inner hollow space of the at least one header tank is divided into at least two chamber sections, wherein at least one gap is formed between the pair of header tanks corresponding to the at least one partitioning member; and at least one resilient blocking element fixedly disposed within the at least one gap, wherein said blocking element is a U-shaped plate member having a pair of plane portions and a connecting portion which extends across the at least one gap and connects one end of each of the plane portions; wherein said blocking element contacts at least a pair of said pipe members.

2. The heat exchanger of claim 1, wherein the U-shaped plate member is disposed over a depth of the at least one gap.

3. The heat exchanger of claim 1, wherein the U-shaped plate member is disposed to a depth of about one-third of the at least one gap.

4. The heat exchanger of claim 1, wherein the U-shaped plate member is made of aluminum or aluminum alloy.

5. The heat exchanger of claim 1, wherein the at least one blocking element made from a material retaining elasticity and having high durability in wet and low temperature environments.

6. The heat exchanger of claim 5, wherein the at least one blocking element is made of ethylene-propylene terpolymer (EPDM).

7. The heat exchanger of claim 1, wherein each of the pair of header tanks has a rectangular parallelpiped shape.

8. The heat exchanger of claim 1, further comprises a pair of side plates between the first side of the sidewall portions of the pair of header tanks and between the second side of the sidewall portion the pair of header tanks.

9. A heat exchanger comprising:

a pair or header tanks spaced from each other, wherein each of the pair of header tanks comprises a top end portion, a bottom end portion spaced from the top end portion, and a sidewall portion connecting the top and bottom end portions, so that a hollow space is defined within each of the pair of header tanks; and wherein the sidewall portion of each of the pair of header tanks includes a first side and a second side which is spaced from and parallel to the first side;

a plurality of pipe members placing the pair of header tanks in fluid communication;

at least one partitioning member fixedly disposed within the hollow space of at least one header tank parallel to the first and second sides of the sidewall portion of each of the pair of header tanks, so that the inner hollow space of the at least one header tank is divided into at least two chamber sections, wherein at least one gap is formed between the pair of header tanks corresponding to the at least one partitioning member; and at least one resilient blocking element fixedly disposed within the at least one gap, wherein the at least one blocking element includes a core plate member and a pair of shell members which sandwich the core plate member; wherein said blocking element contacts at least a pair of said pipe members.

10. The heat exchanger of claim 9, wherein the pair of shell members are made from a material retaining elasticity and having high durability in wet and in low temperature environments.

11. The heat exchanger of claim 10, wherein the pair of shells are made of ethylene-propylene terpolymer (EPDM).

12. The heat exchanger of claim 10, wherein the core plate member is made of aluminum or aluminum alloy.

* * * * *